United States Patent [19]

Smock et al.

[11] Patent Number: 4,650,945

[45] Date of Patent: Mar. 17, 1987

[54] FOUR TERMINAL SWITCH

[75] Inventors: Steven W. Smock, Indianapolis; William J. Hueber, Brownsburg, both of Ind.

[73] Assignee: Emhart Industries, Inc., Indianapolis, Ind.

[21] Appl. No.: 402,163

[22] Filed: Jul. 26, 1982

[51] Int. Cl.[4] ..... H01H 3/12; H01H 21/68

[52] U.S. Cl. ..... 200/283; 200/284; 200/159 A; 200/340; 200/16 B

[58] Field of Search ..... 200/283, 159 A, 284, 200/61.76–61.79, 16 A, 16 B, 16 C, 16 E, 159 R, 314, 340

[56] References Cited

U.S. PATENT DOCUMENTS

| | | | |
|---|---|---|---|
| 3,104,300 | 9/1963 | Hutt | 200/159 R |
| 3,172,981 | 3/1965 | Loesch | 200/61.76 |
| 3,258,548 | 6/1966 | Cartier et al. | 200/16 A |
| 3,286,049 | 11/1966 | Drain | 200/16 A |
| 3,472,975 | 10/1969 | Soreng et al. | 200/16 C |
| 3,696,222 | 10/1972 | Langan et al. | 200/328 X |
| 3,855,558 | 12/1974 | Hayward | 200/16 A X |
| 3,958,090 | 5/1976 | Garcia | 200/277 X |
| 3,989,912 | 11/1976 | Franike | 200/159 A |
| 4,064,381 | 12/1977 | Mullen et al. | 200/16 A |
| 4,225,758 | 9/1980 | Kondo et al. | 200/159 A X |
| 4,282,414 | 8/1981 | Johnston et al. | 200/16 A X |
| 4,317,972 | 3/1982 | Kjellberg | 200/16 A X |

*Primary Examiner*—Stephen Marcus
*Assistant Examiner*—Ernest G. Cusick
*Attorney, Agent, or Firm*—Robert F. Meyer

[57] ABSTRACT

A switch has four separate electrical terminals. A first electrical contact selectively electrically bridges three of the four terminals while a second electrical contact selectively bridges the fourth terminal and one of the first three.

4 Claims, 6 Drawing Figures

FOUR TERMINAL SWITCH

BACKGROUND OF THE INVENTION

The present invention relates to a switch which, in general, comprises a housing, four electrical terminals carried in and extending through the housing, independently operable first and second bussing means, the first bussing means selectively electrically bridging three of the four electrical terminals, and the second bussing means selectively electrically bridging a fourth of the four electrical terminals and one of the three electrical terminals.

The switch of the present invention is particularly useful as an engagement switch for an electronic speed regulating device commonly used in automobiles. The switch of the present invention is particularly adaptable to being attached to the turn signal lever on a steering column of the automobile and as such is very neat and compact and because of its switch terminal arrangement is very reliable.

OBJECTS OR FEATURES OF THE INVENTION

A feature of the present invention is to provide a four terminal switch that is particularly adaptable as an engagement switch for an electronic speed regulating device. Another feature of the invention is to provide such a switch wherein three of the four electrical terminals are selectively bridged by a first bussing means and wherein a second bussing means selectively electrically bridges a fourth of the four electrical terminals and one of the other three electrical terminals. These and other features of the invention will become apparent from the following description taken in conjunction with the accompanying drawings.

DETAILED DESCRIPTION OF THE INVENTION

Figure 1:
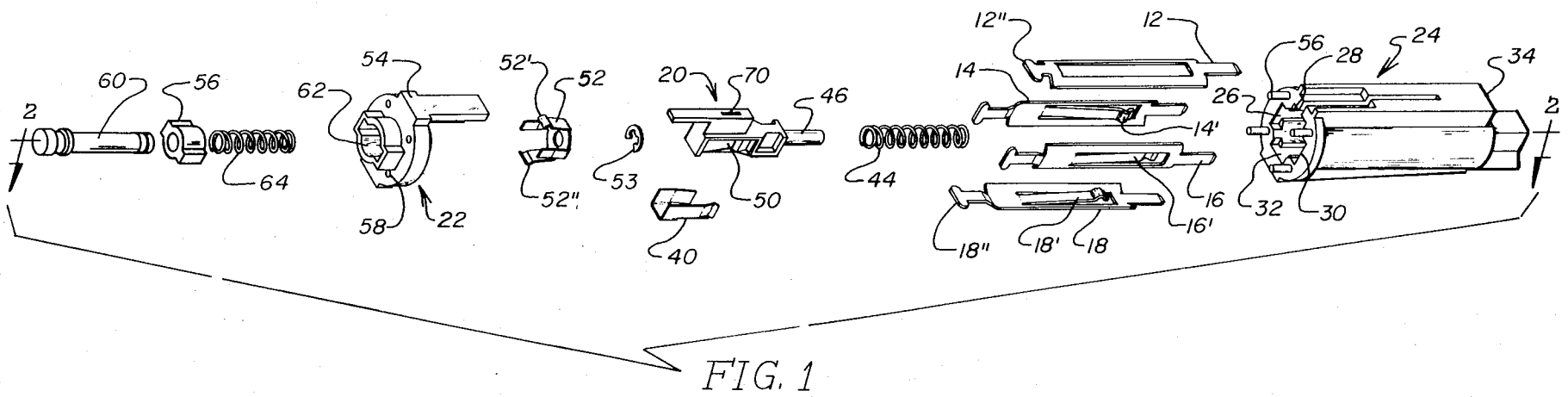
FIG. 1 is an exploded view of a four terminal switch employing the features of the invention.

Referring now to the drawings, and in particular FIG. 1, there is shown a switch 10 which, in general, includes four electrical terminals 12, 14, 16 and 18, and electrical bussing means 20 and 22 which are all carried in an elongated housing 24. The electrical terminals are carried in slots 26, 28, 30 and 32, which are provided in the walls of the elongated housing. As better shown in FIGS. 2–6, the terminals extend outside of the end 34 of the housing for connection to electrical circuitry of a speed regulating control. As shown, three of the electrical terminals include an electrical contact spring blade 14', 16' and 18' lanced from their particular terminals.

Figure 2:
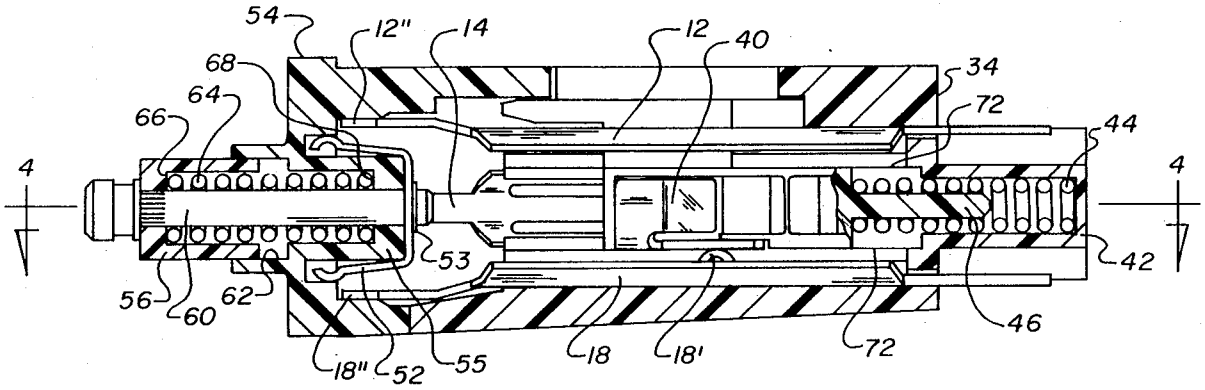
FIGS. 2 and 3 are sections taken along the line 2—2 of FIG. 1 showing different operating positions of the switch.

Referring to FIGS. 1 and 2, bussing means 20 includes a holder 36 which is slideably carried on rails 38 provided in the housing and a three sided electrical contact 40 carried by the holder. The holder is spring biased against an end 42 of the housing through a coil spring 44 which is carried on rod 46 extending from the holder. The three sided electrical contact is carried in a cavity 48 of the holder and is held against a shelf 50 on three sides. Bussing means 22 includes a clip spring electrical contact 52 fixedly carried on a shaft 60 within a cover 54 of housing 24. A clip ring 53 holds the clip spring 52 against a hub 55 provided in the cover. Cover 54 is carried on housing 24 through four posts 56 engaging four holes 58 provided in the cover. A slider 57 is fixedly carried on shaft 60 and is slideably carried in a cavity 62 of cover 54. Slider 56 is spring biased through a coil spring 64 which is carried on shaft 60 and is held between an end 66 of the slider and a wall 68 of cover 54.

Bussing means 20 and 22 operate independently of each other. Thus, electrical contact 40 is actuated by a handle (not shown) which is carried in slot 70 of holder 36 and which slides in slot 72 (FIG. 2) of housing 24. Actuation of electrical contact 40 causes engagement of the contact with electrical terminals 14, 16 and 18 through their respective spring blades 14', 16' and 18'. Electrical contact 52 is actuated by pushing an end of shaft 60, the shaft being guided by slider 56 in holder 54. Actuation of electrical contact 52 causes engagement of the contact with tabs 12" and 18" of terminals 12 and 18 through spring blades 52' and 52" of the electrical contact.

Figure 3:
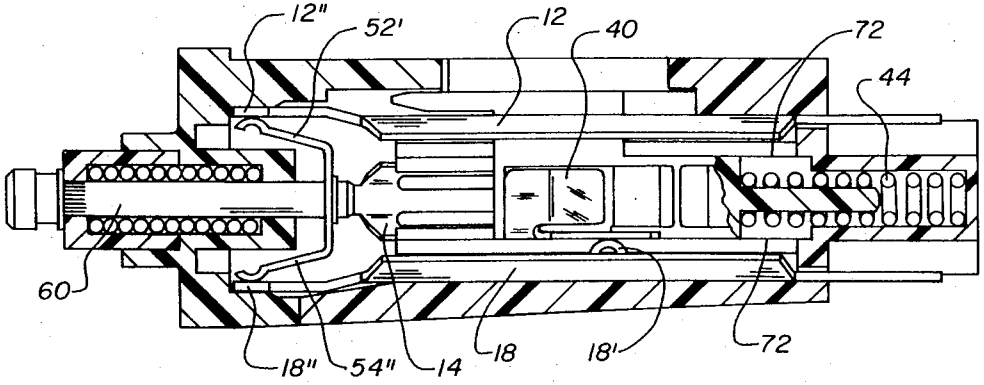
Figure 4:
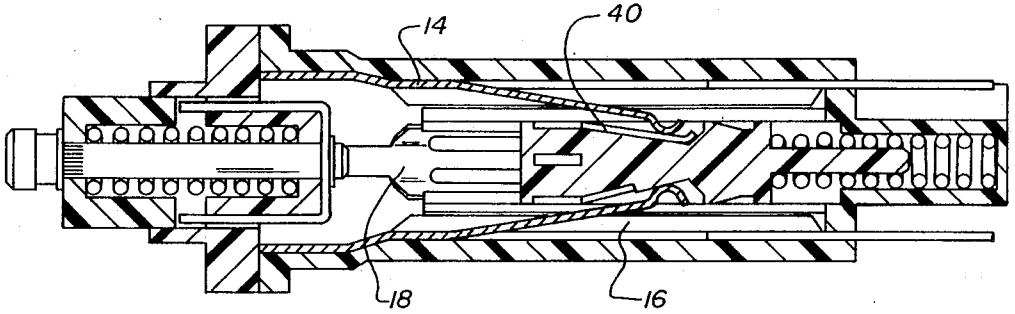
FIGS. 4–6 are sections taken along the line 4—4 of FIG. 2 showing three different operating positions of the switch.

Referring now to FIGS. 2–6, the operation of the switch can now be described as it would be used in a speed regulating device of an automobile. In FIG. 2, electrical contact 40 has been actuated to engage electrical terminals 14 and 18. In this position, electrical power has been supplied to the switch. In FIG. 3, electrical contact 52 has been momentarily engaged with terminals 12 and 18 by pushing shaft 60 in, with power being supplied through terminal 14 to set the cruise control speed. When shaft 60 is released, the desired cruising speed is set, and as shown in FIG. 4, terminals 14 and 18 are engaged by electrical contact 40 to maintain such speed.

Figure 5:
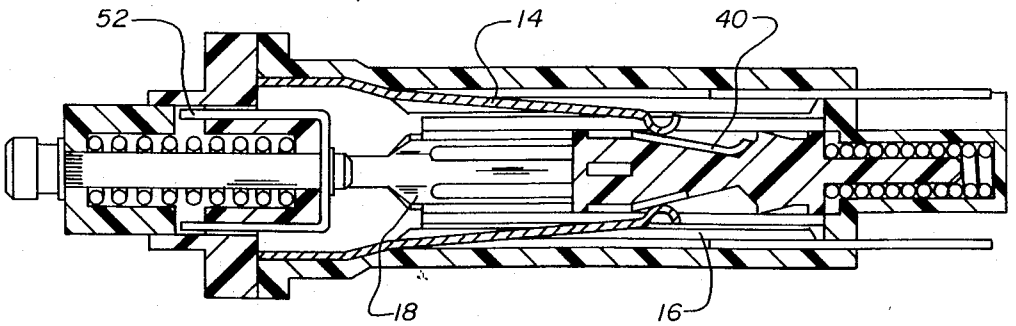
Figure 6:
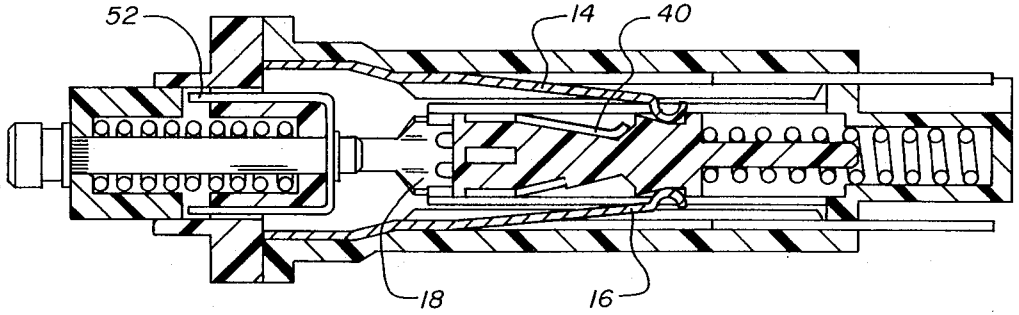

In FIG. 5, the operator has decided to accelerate by engaging electrical contact 40 with terminals 14, 16 and 18. Upon reaching the desired speed, electrical contact 40 is released to return to the "on" position of FIG. 4 (terminals 14 and 18 engaged by electrical contact 40). In FIG. 6, all terminals have been disengaged to shut all power off.

In those cases where the automobile brake is applied, all power is shut off to switch 10 by another switch actuated by the brake. When cruise speed is again desired, electrical contact 40 is again actuated to the position of FIG. 2 and a computer in the complete control system resets the desired speed and operation continues in the mode of FIG. 4.

What is claimed is:

1. A switch comprising a housing, four electrical terminals carried in and extending outside said housing, first and second individual bussing means, and first and second means independently sliding said first and second bussing means to selectively engage same with said electrical terminals to complete electrical circuits, said first bussing means engaging a first and second electrical terminal when moved to a first position, said second bussing means momentarily engaging said first electrical terminal and a third electrical terminal when in said first position, and in a second position said first bussing means engaging said first and second electrical terminals and a fourth electrical terminal and said second bussing means being disengaged from said first and third electrical terminals.

2. A switch according to claim 1 wherein said housing is elongated and said four electrical terminals are each thin elongated strips one each carried on a side of said housing.

3. A switch according to claim 2 wherein said first bussing means includes a first axially spring biased electrical contact holder and an electrical contact carried on three sides of said holder.

4. A switch according to claim 2 wherein said second bussing means includes an axially spring biased electrical contact holder and a second and spring clip electrical contact carried by said holder.

* * * * *